United States Patent [19]

Herbstman et al.

[11] Patent Number: 4,997,455

[45] Date of Patent: Mar. 5, 1991

[54] DIESEL FUEL INJECTOR CLEANING ADDITIVE

[75] Inventors: Sheldon Herbstman, New City; Kashmir S. Virk, Hopewell Junction, both of N.Y.

[73] Assignee: Texaco Inc., White Plains, N.Y.

[21] Appl. No.: 269,343

[22] Filed: Nov. 3, 1988

[51] Int. Cl.[5] ..... C10L 1/02

[52] U.S. Cl. ..... 44/407

[58] Field of Search ..... 44/53, 56, 71, 57, 66; 123/1 A, 198 A

[56] References Cited

U.S. PATENT DOCUMENTS

| | | | |
|---|---|---|---|
| 2,699,427 | 1/1955 | Smith et al. | 44/68 |
| 3,773,479 | 11/1973 | Dorn et al. | 44/71 |
| 3,876,704 | 4/1975 | Nakaguchi | 44/72 |
| 4,047,900 | 9/1977 | Dorn et al. | 44/71 |
| 4,144,034 | 3/1979 | Cummings | 44/71 |
| 4,144,036 | 3/1979 | Cummings | 44/71 |
| 4,198,931 | 4/1980 | Malec | 44/71 |
| 4,204,481 | 5/1980 | Malec | 44/71 |
| 4,204,841 | 5/1980 | Biasotti et al. | 44/71 |
| 4,207,079 | 6/1980 | Herbstman et al. | 44/71 |
| 4,689,051 | 8/1987 | Sung | 44/72 |

*Primary Examiner*—Margaret B. Medley

*Attorney, Agent, or Firm*—Robert A. Kulason; James J. O'Loughlin; Vincent A. Mallare

[57] ABSTRACT

A diesel fuel and injector cleaning additive which comprises a solvent such as a ($C_3$–$C_5$) alcohol and an amino alkylene-substituted asparagine.

1 Claim, 1 Drawing Sheet

DIESEL FUEL INJECTOR CLEANING ADDITIVE

BACKGROUND OF THE INVENTION

In the use of diesel fuels in diesel engines, the fuels degradation products will build up on metal surfaces and will clog the injectors of the diesel engines.

When diesel fuel injectors become clogged or develop deposits, the spray of the fuel into the combustion chamber is not uniform and/or atomized properly, resulting in poor combustion, increased exhaust emissions and smoke and degraded fuel economy and power. Eventually, these deposits build up to the point which would require replacement or some special maintenance. In extreme cases, irregular combustion could cause hot spots on the piston which have resulted in total engine failure requiring a complete engine overhaul or replacement.

Since there has been a need for making certain that diesel fuel injectors are clean during operation of the diesel engines, several additives and filters have been developed to clean diesel fuel injectors.

According to the present invention, it has been found that a gasoline cleaning additive described in U.S. Pat. No. 4,204,041 is also an excellent cleaning additive for diesel fuels since it prevents diesel fuel injectors from clogging. This result was unexpected since it was not thought that the cleaning additive in the gasoline detergent would be sufficiently thermally stable to withstand the high temperatures found at the fuel injector tips of the diesel engine. Thus, it is an object of the present invention to provide a means for keeping diesel fuel injectors clean.

DISCLOSURE STATEMENT

U.S. Pat. No. 4,204,041 discloses a detergent gasoline composition which comprises a mixture of hydrocarbons in the gasoline boiling range.

SUMMARY OF THE INVENTION

This invention provides a diesel fuel composition which comprises:

(a) a major portion of a diesel fuel; and (b) a minor amount, as a diesel fuel injector cleaning additive, of a compound comprising:

(i) a solvent selected from the group consisting of kerosene, Avjet and a ($C_3$ to $C_5$) alcohol; and (ii) a primary aliphatic hydrocarbon amino alkylene-substituted asparagine represented by the formula

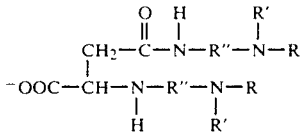

in which R is a primary ($C_6$–$C_{30}$) aliphatic hydrocarbon group, R′ is a hydrogen or a methyl and R″ is a ($C_2$–$C_{10}$) alkylene group.

DRAWING

The advantages of the present invention will be more clear from the description set forth below, particularly when considered with the drawing which is:

FIG. 1 is a graph illustrating the results of a single cylinder engine which compares a base diesel fuel with that of the present invention.

DETAILED DESCRIPTION OF THE INVENTION

Figure 1:
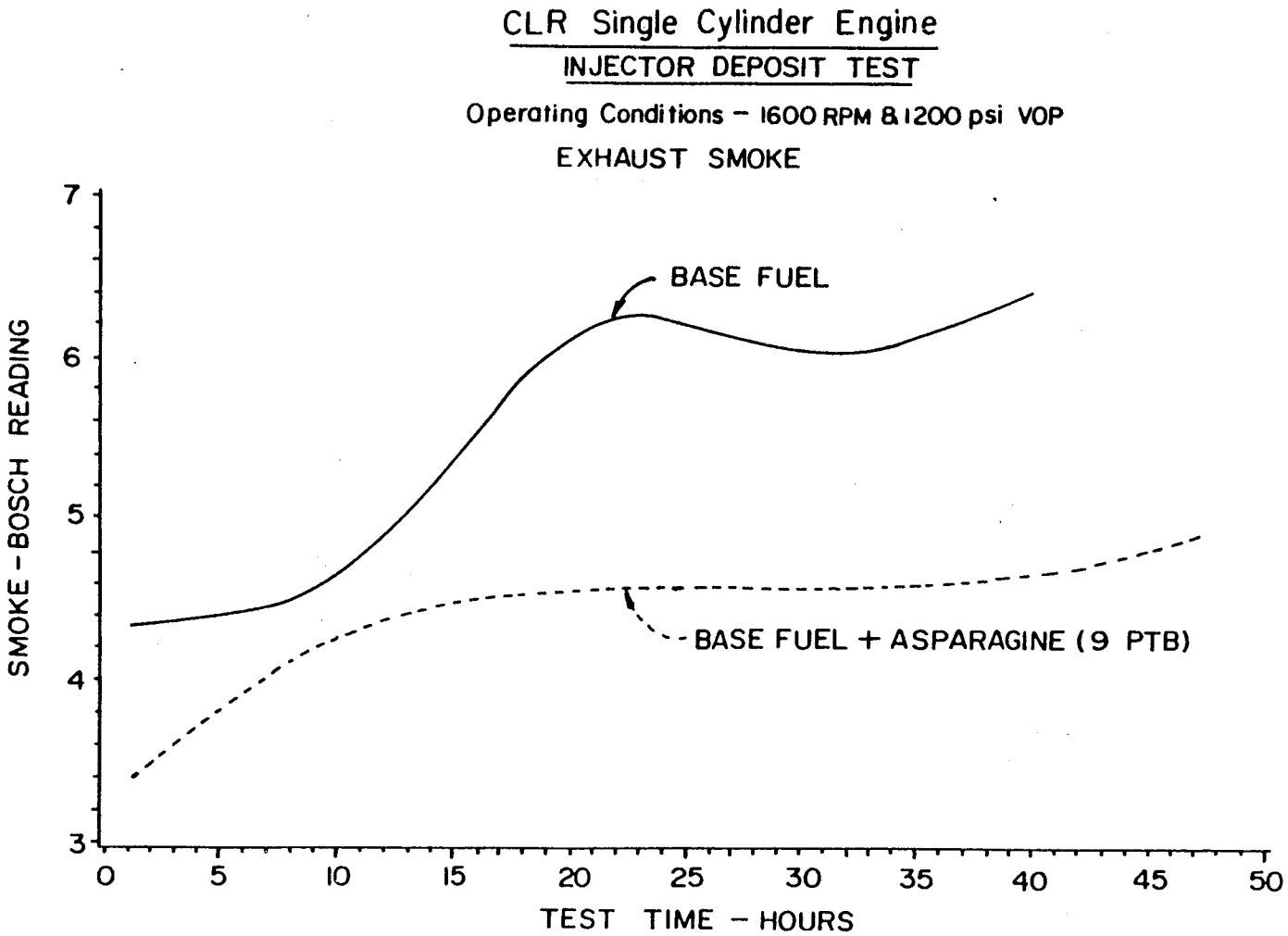

The present invention utilizes a detergent additive in a diesel fuel composition to make certain that the fuel injectors are kept clean and functioning properly.

The diesel fuel composition comprises:

(a) major portion of a diesel fuel; and (b) a minor amount, as a diesel fuel injector cleaning additive, of a compound comprising (i) a solvent selected from the group consisting of kerosene, Avjet and a ($C_3$–$C_5$) alcohol; and (ii) a primary aliphatic hydrocarbon amino alkylene-substituted asparagine represented by the formula

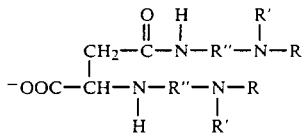

in which R is a primary ($C_6$–$C_{30}$) aliphatic hydrocarbon group, R′ is hydrogen or a methyl group and R″ is a ($C_2$–$C_{10}$) alkylene group.

The solvent used, as set forth above, may be kerosene, Avjet, or a ($C_3$ to $C_5$ ) alcohol selected from the group consisting of propanol, 2-propanol, butanol, 2-butanol, 2-pentanol and amyl alcohol.

Examples of specific primary aliphatic hydrocarbon amino alkylene-substituted asparagine additives for the diesel fuel composition of this invention include the following:

N,N′di-(3-n-oleylamino-1-propyl)asparagine
N,N′-di-(3-n-dodecylamino-1-propyl)asparagine
N,N′-di-(3-octylamino-1-propyl)asparagine
N,N′-di-(3-stearylamino-1-propyl)asparagine
N,N′-di-(3-decylamino-1-propyl)asparagine
N,N′-di-(3-laurylamino-1-propyl)asparagine
N,N-di-(3-benhenylamino-1-propyl)asparagine According to the present invention, the amount of diesel fuel injector cleaning additive in the motor fuel composition ranges from about 1.0 to about 200 PTB.

As illustrated in FIG.1, the graph summarizes the results of a CLR Single Cylinder Engine Injector Deposit Test comparing the Bosch Smoke Number (BSN) for a diesel base fuel and this same fuel containing 9 PTB of the present diesel fuel cleaning additive composition. In the tests, the higher BSN indicates more deposits from the fuel in the diesel engine injectors.

In the Injector Deposit Test, a single cylinder direct injection CLR engine was used. The engine was operated under the following conditions:

| | |
|---|---|
| Engine speed | 1600 RPM |
| Fuel consumption rate | 2.4 lbs/hr |
| Air consumption rate | 18.0 CFM |
| Fuel injection timing | 10.0 BTDC |
| Injector valve opening pressure | 2500 PSI* |

*Before each fuel test, the infector was thoroughly cleaned in an ultrasonic cleaner and a detergent solution.

As shown in FIG. 1, the base fuel, as shown by a regression line, indicated a rapid increase in exhaust smoke (BSN) over 100 hr. while the regression line for the fuel containing the present cleaning additive was relatively constant over this period time. The increase in smoke level was due to the partial clogging of the fuel injectors with resins and carbonized material which formed due to contact of the fuel with the injectors at high temperatures. The presence of the present cleaning additive helped clean up the deposits as they formed. These test results clearly show the effectiveness of the present cleaning additive in a keep clean test.

It will be evident that the terms and expressions employed herein are used as terms of description and not of limitation. There is no invention, in the use of these descriptive terms and expressions, of excluding equivalents of the features described and it is recognized that various modifications are possible within the scope of the invention claimed.

We claim:

1. A diesel fuel composition comprising:

(a) a major portion greater than 50% of said fuel composition of a diesel fuel; and (b) a minor amount of less than 50% of said fuel composition, as a diesel fuel injector cleaning additive, of about 1.0 to about 200 PTB of a compound comprising (i) a solvent selected from the group consisting of kerosene, Avjet and a ($C_3$–$C_5$) alcohol selected from the group consisting of propanol, 2-propanol, butanol, 2-butanol, 2-pentanol and amyl alcohol; and (ii) N,N'di(3-oleyl amino-1-propyl) asparagine.

* * * * *